United States Patent [19]

Shellow et al.

[11] 3,972,079

[45] Aug. 3, 1976

[54] SEATING UNIT CONVERTIBLE TO A BED

[75] Inventors: Robert M. Shellow, North Miami, Fla.; Urban A. Weidner, Park Ridge, Ill.

[73] Assignee: Mak-Kraft Creations, Inc., Kaleva, Mich.

[22] Filed: Apr. 30, 1975

[21] Appl. No.: 573,268

[52] U.S. Cl. ..... 5/18 R; 5/12 R; 297/107

[51] Int. Cl.[2] ..... A47C 17/14; A47C 13/00

[58] Field of Search ..... 5/12, 13, 17, 18; 297/107, 112, 118

[56] References Cited

UNITED STATES PATENTS

| | | | |
|---|---|---|---|
| 2,784,419 | 3/1959 | Cimon | 5/18 R |
| 3,505,694 | 4/1970 | Pesta | 5/17 |
| 3,710,403 | 1/1973 | Weidner et al. | 5/12 R |
| 3,743,351 | 7/1973 | Harris | 297/107 |

*Primary Examiner*—Casmir A. Nunberg

*Attorney, Agent, or Firm*—Max R. Kraus

[57] ABSTRACT

A seating unit which is convertible to a bed and comprises an outer seating section which is supported on a floor surface and which forms a slideable unit, and an inner section positioned within the outer seating section and supported on the same floor surface independently of the outer seating section. The inner section remains stationary as the outer section is slid longitudinally of the inner section so that the outer seating section forms a continuation of the stationary inner section to convert the unit to a bed.

9 Claims, 8 Drawing Figures

SEATING UNIT CONVERTIBLE TO A BED

BRIEF SUMMARY OF THE INVENTION

It is well-recognized that a seating unit convertible to a bed is old and well-known and is exemplified in the prior art. However, such prior art units comprise an outer seating section with an inner slideable section, which inner slideable section is supported for longitudinal sliding movement on said outer section so that when the inner slideable section is extended linearly the seating unit is converted to a bed. Such prior art units have the following disadvantages.

In instances where the seating section is a one arm-sofa the slideable inner section has no arm rest at the outer end thereof, thus, a person has to stoop or bend to an awkward position to engage the slideable inner section and in this stooped or bent position to slide it outwardly of the stationary seating section. Stooping or bending to perform this function can be injurious to a person's back. In instances where the inner slideable section has an arm rest at the outer end so that with the one-arm rest of the seating section it forms a two-arm seating unit or love seat, it has been found that by the repeated manual engagement of that arm rest for the purpose of sliding the inner section out, the arm rest on the slideable inner section will tend to weaken and break down as said arm rest does not have the strength or the reinforcement of the arm rest on the seating section.

With this invention all of the foregoing disadvantages are eliminated in that the inner section forms the stationary part and the seating section with the strengthened and reinforced arm rest forms the slideable section so that repeated engagement of the arm rest for the purpose of sliding the seating section longitudinally of the stationary inner section does not weaken the arm rest or result in the breaking off thereof. Since the outer seating section or the slideable member always has an arm rest at the outer end, it is always available for manual engagement and thus stooping or bending is eliminated.

Another object of this invention is to provide an outer slideable seat section and an inner stationary section, each independently supported on a floor surface and positioned one within the other but in a spaced relationship so that sliding the outer slideable seat section longitudinally relative to the stationary inner section does not impart any sliding movement of the inner section.

Another object of this invention is to provide means for limiting the outward longitudinal sliding movement of the outer slideable seat section relative to the stationary inner section so that both sections form a sofa bed.

Another object of this invention is to provide means for locking the outer and inner sections together when same are positioned one within the other to permit their movement together as a unit.

BRIEF DESCRIPTION OF THE DRAWINGS

In the drawings:

Essentially, the only difference between the embodiments shown in FIG. 1 and FIG. 2 is that FIG. 1 shows a one-arm seat unit whereas FIG. 2 shows a two-arm seat unit, namely, a love seat. In the FIG. 2 embodiment one of the arms is affixed to the stationary inner section.

In the construction forming this invention the outer section which forms the sofa or the seat section of the unit is slideable longitudinally relative to the inner section which remains stationary on the floor surface. Since the outer slideable seat section and the stationary inner section are each independently supported on the floor surface, the stationary inner section while confined within the slideable outer seat section is not supported by the outer section, but is independently supported, as will be more fully understood in connection with the description.

Figure 3:
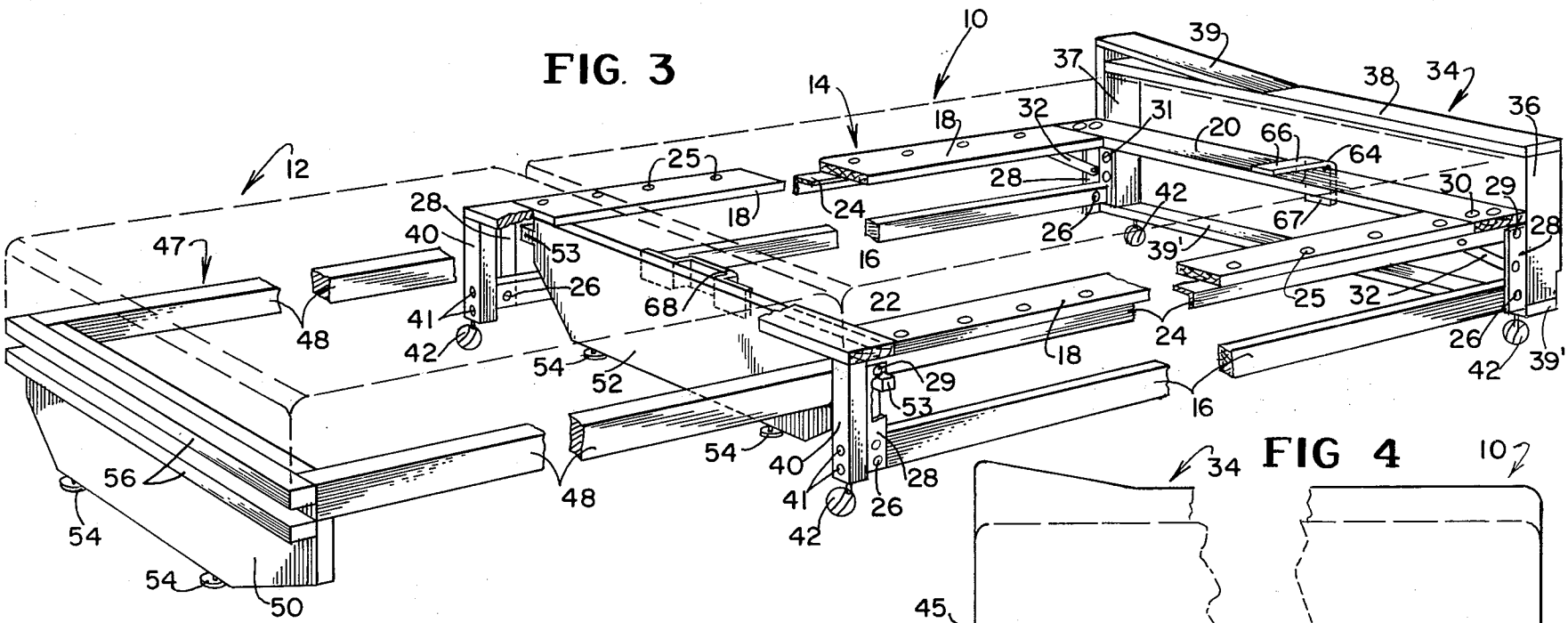
FIG. 3 is a view of the outer frame member forming the slideable outer seating section and the inner frame member forming the inner stationary section, with the outer seating section longitudinally extended to form a bed.

The slideable outer seat section, whether it be a sofa or a love seat, is generally designated at 10 and the stationary inner section is generally designated at 12. In converting the slideable outer seat section to a bed, the outer seat section 10 is slid longitudinally with respect to the stationary inner section 12, as in FIG. 1, which extends the outer section 10 away from the stationary inner section 12 to convert same to a bed. As best seen in FIG. 3, the slideable outer section 10 forming the seat portion comprises a frame member generally designated at 14 which includes a pair of spaced longitudinal bottom side rails 16, a pair of spaced longitudinal top side rails 18, a pair of spaced end rails 20 and 22, and longitudinally extending side angle bars 24 secured by suitable fastening means 25 to the underside of the top side rails 18. The bottom side rails 16 are fastened at their ends by fastening means 26 to vertically extending angle bars 28, with the longitudinally extending side angle bars 24 likewise fastened as at 29 at their opposite ends to the vertical angle bars 28. The longitudinal top side rails 18 are shorter than the longitudinal right angle bars 24 so that the end cross-members 20 and 22 can be positioned on said angle bars 24 and be secured thereto by suitable fastening means 30. At the corners bracing strips 32 are secured to the vertical angle bars 28 and to the longitudinal angle bars 24 by suitable fastening elements. There is thus provided a rectangular-shaped frame member which is part of the slideable outer seating section 10, with most of the elements being made of wood, except for the longitudinal right angle bars 24 and the vertical angle bars 28 and the bracing strips 32 which are made of metal.

Fixedly secured to the outer end of said slideable outer frame section 10 is an arm generally indicated at 34 which is formed of a pair of spaced vertically extending strips 36 and 37 which are connected to the vertical angle bars 28 by fastening elements 31, with said vertical strips connected by a top cross strip 38. An inclined strip 39 is secured to the top strip 38 and to the upper end of the rear vertical strip 37 which extends upwardly of the front vertical strip 36 to provide the arm rest 34 with an inclined upper rear surface, as can be seen in the upholstered and finished form in FIGS. 1 and 2. A bottom cross strip 39' is fixedly secured to the vertical strips 36 and 37. The bottom strip 39' is similar to top cross strip 38. Secured to said bottom cross strip adjacent the opposite ends thereof are suitable rollers or casters 42.

The slideable frame 14 of the outer section 10 has vertically extending legs 40 at the inner end which are suitably secured by fastening elements 41 to the vertical angle bars 28. The vertically extending legs 40 are also provided with suitable rollers or casters 42. Thus, the two legs 40 and the arm rest 34 of the slideable portion have suitable rollers or casters.

Supported on and secured to the rectangular-shaped frame 14 of the outer section so as to extend across the top of said frame is a conventional grid spring assembly generally indicated at 43. Such a spring grid assembly is sold under the trademark "PERMA-EZE" and is manufactured by the Flex-O-Lator Company. The conventional under seat cushion 44 and an upper seat cushion 45 can be positioned thereon. It will be seen that the slideable outer seat section 10 forming the seat or sofa portion is independently supported on a floor surface for sliding movement and that the framework member thereof forms a rectangular-shaped pocket generally indicated at 46 below the top longitudinal side rails and end rails to receive therewithin the stationary inner section 12, which will now be described.

The framework of the stationary inner section 12 which is generally indicated at 47 comprises a pair of spaced longitudinal top side rails 48 formed preferably of wood, connected to spaced opposite end members 50 and 52 which extend to substantially the floor surface. The said end members are provided with conventional metal glides 54. The outer end member 50 may be provided with additional spaced spacer strips 56 in order to bring the upholstery fabric in a vertical line with the top cross member 22. The end member 50 is thereby offset inwardly from the end and is not so readily visible when viewed from the end. The inner end member 52 has lateral extensions 53 which serve as stop means and engage the inner vertical legs 40 to limit the outward longitudinal sliding movement of the movable seat frame section 10 with respect to the stationary frame section 12, as best seen in FIG. 3.

Figure 7:
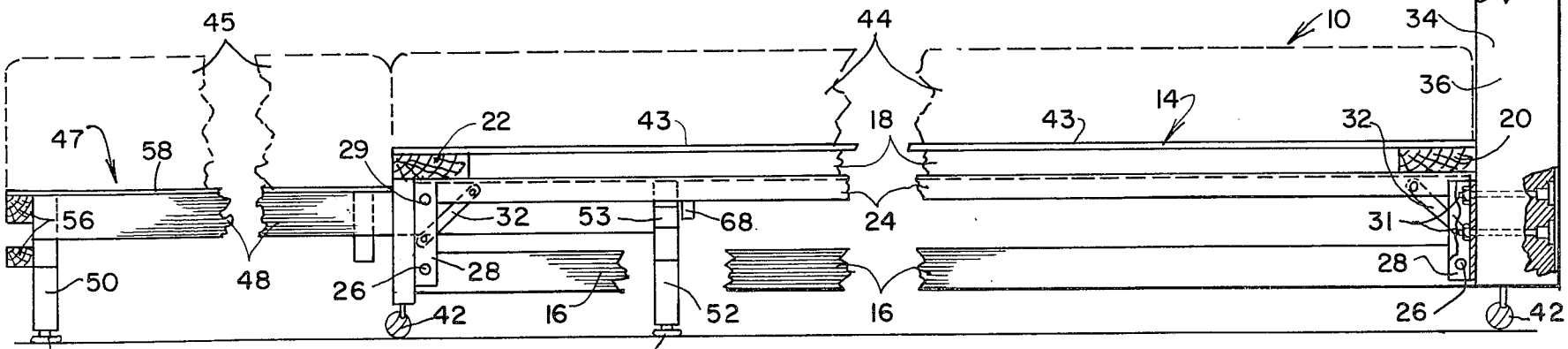
FIG. 7 is an elevational view taken on line 7—7 of FIG. 6.

The top of the framework 47 of the stationary inner section 12 supports and has secured to it a conventional grid spring assembly generally indicated at 58, similar to the grid spring assembly 43 previously described, so that when the outer section 10 is slid away outwardly from the stationary inner section 12, the upper seat cushion 45 which was formerly positioned on the outer section 10 is placed on said stationary inner section 12, as best seen in dotted lines in FIG. 7, so that the tops of the cushions will be on the same horizontal plane to serve as a bed.

Figure 4:
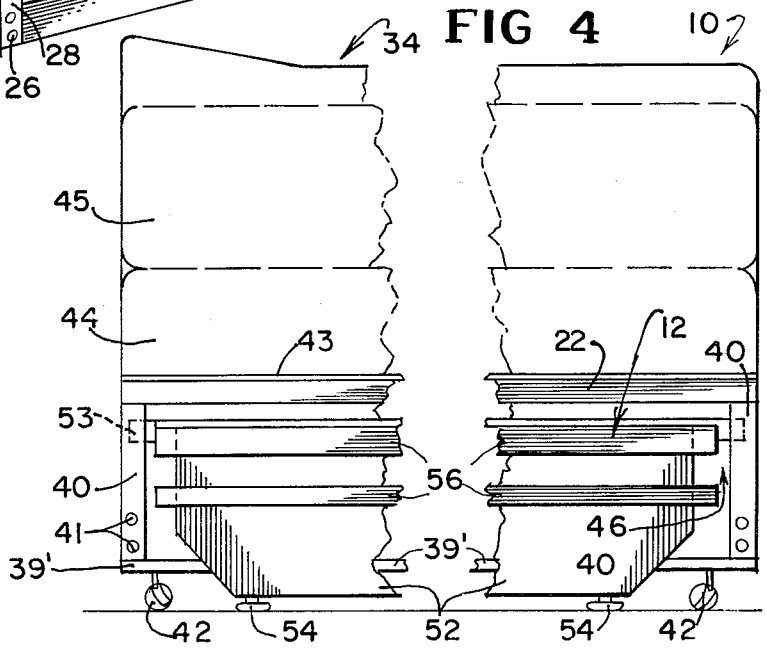
FIG. 4 is an end elevational view showing the inner section positioned within the outer section.

It will be seen that the stationary inner section 12 is independently supported on the floor surface whether it is in its confined position in the pocket 46 within the slidable outer section 10 or when the outer section 10 is in extended position with respect to the stationary inner section. In other words, the inner section 12 does not depend for any of its support on the outer section but is independently supported on the floor surface, as is the slideable outer section. Thus, both the stationary inner section 12 and the slideable outer section 10 are each independently supported on the floor surface. As can best be seen in FIG. 4, the longitudinal sides and top of the stationary inner section 12 are spaced from the sides and bottom of the slideable outer section 10 and each is independently supported with regard to the other so that sliding the outer section 10 will not affect or move the inner section 12.

Figure 1:
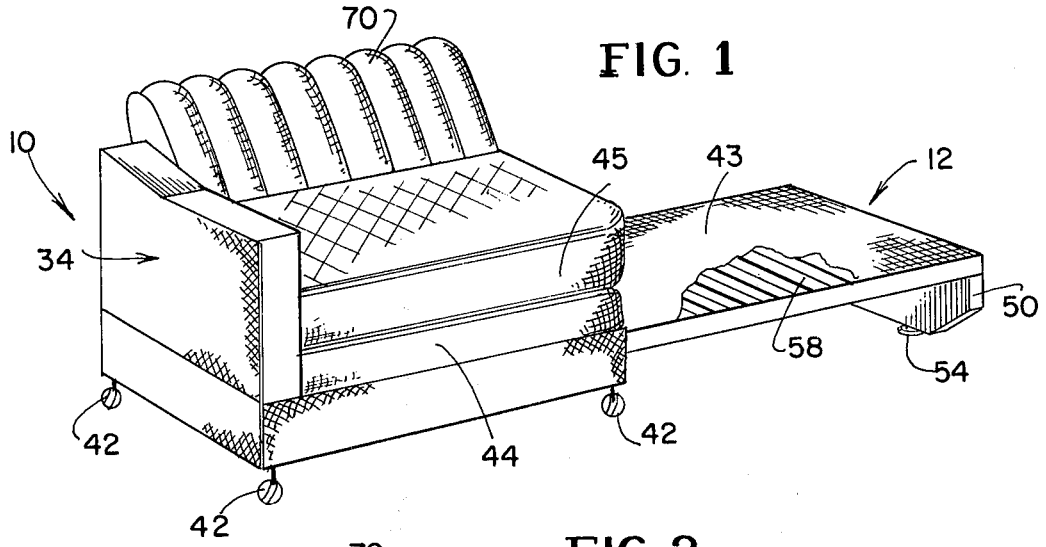
FIG. 1 is a perspective view of the invention showing a one-arm seating unit forming the outer seating section moved to the longitudinally extended position with respect to the stationary inner section to convert same to a bed.

In the one-arm seating unit illustrated in FIG. 1, when it is desired to extend the outer seat section with respect to the stationary inner section, the arm rest 34 of the slideable outer section 10 is manually engaged and the outer section is moved laterally away from the stationary inner section 12 to the position shown in FIG. 1 where the stop means 53 on the stationary framework 47 engages the legs 40 of the slideable outer section 10 to limit the outward movement of the slideable outer section. This extends the two sections relative to each other to form a bed.

Figure 2:
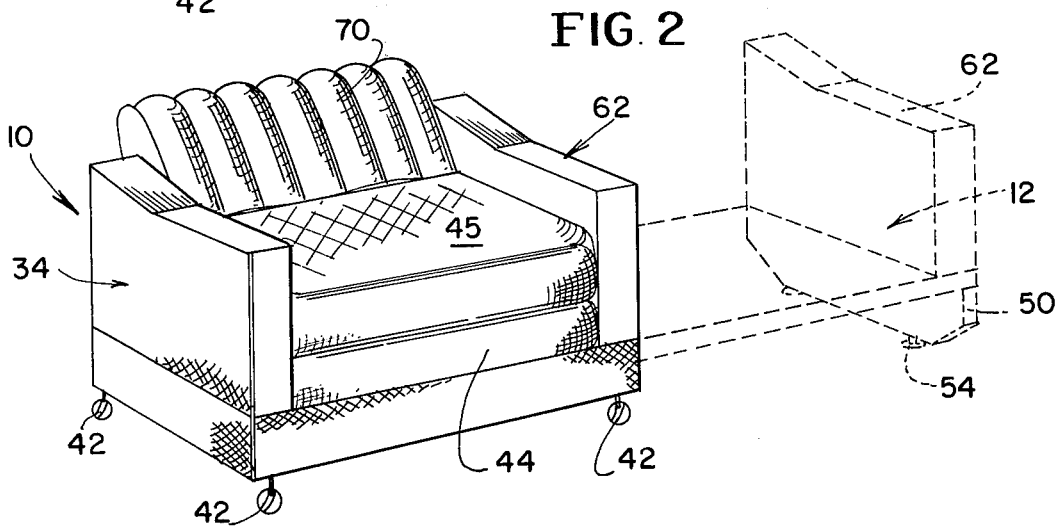
FIG. 2 in full lines is a view of this invention showing a seating unit in the form of a love seat, and showing in dotted lines the love seat converted to a bed.
Figure 8:
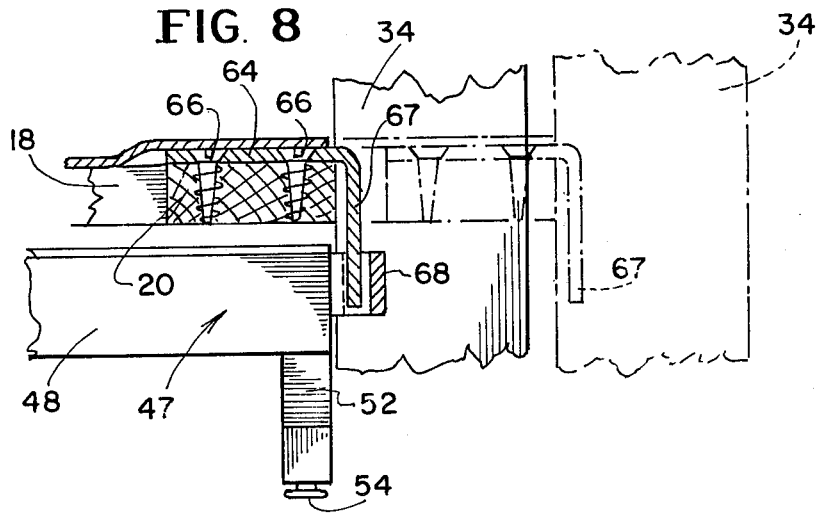
FIG. 8 is a view partly in section taken on line 8—8 of FIG. 6.

In connection with the love seat embodiment shown in FIG. 2, the only difference is that the framework 47 of the stationary inner section is provided with an arm rest framework generally indicated at 62 which is similar to the arm rest framework of the outer section, and said arm rest framework 62 would be secured to the framework of the stationary inner section adjacent the outer end thereof, namely, at the end defined by the end member 50, so that when the outer section is moved inwardly with respect to the inner section, the outer seat section would have one arm and the stationary inner section would have the other arm to form the love seat shown in full lines in FIG. 2.

Figure 5:
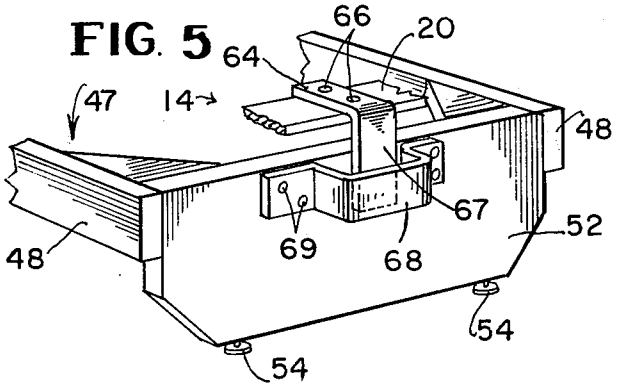
FIG. 5 is a fragmentary perspective view of the latching means for latching the two sections together, one within the other.
Figure 6:
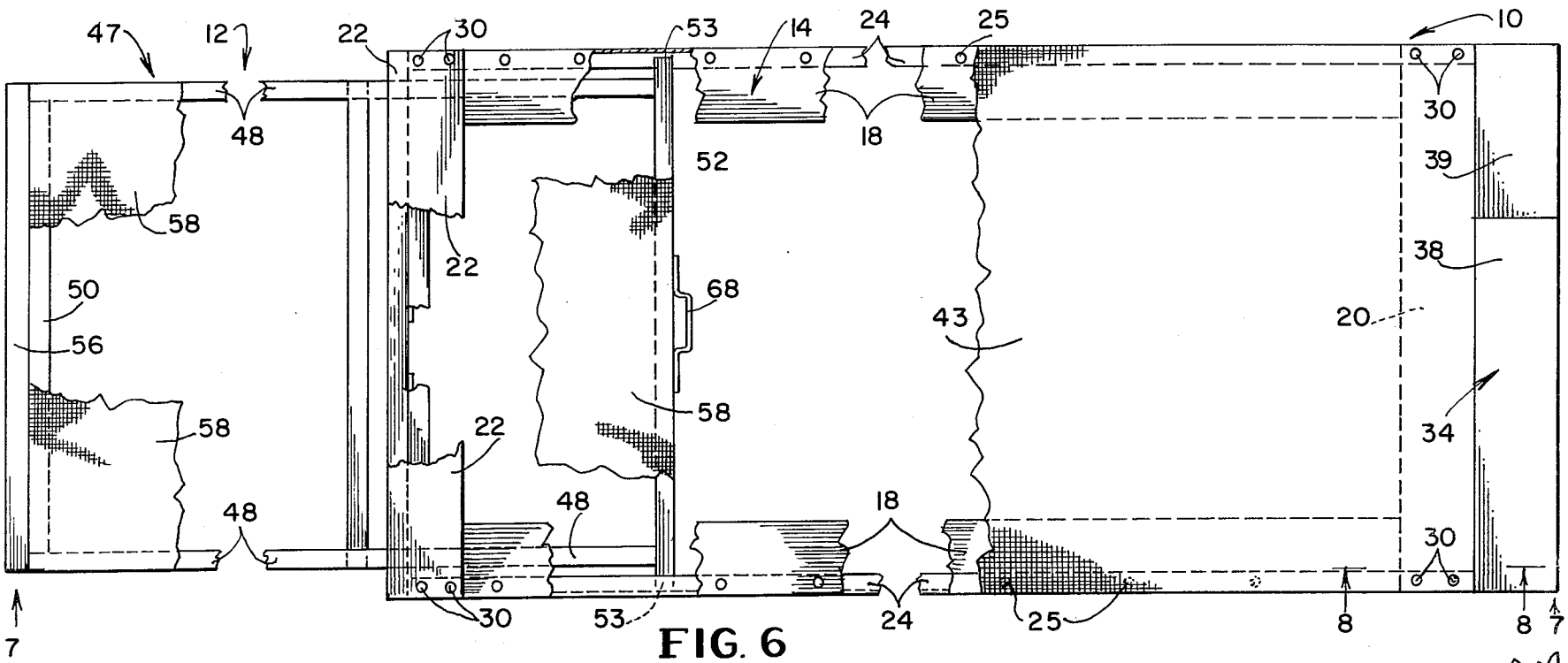
FIG. 6 is a top plan view partly in section of the frame members in partially extended position.

The end rail 20 of the slideable seat frame section 14 adjacent the side arm frame 34 has an inverted L-shaped metal member 64 secured thereto by fastening elements 66 and said L-shaped member is positioned centrally of said end rail 20 and the leg 67 thereof depends below said end rail 20, as best seen in FIGS. 3 and 5. The inner end member 52 of the stationary frame 47 has a generally U-shaped bracket indicated at 68 secured thereto by fastening elements 69 and same is positioned in alinement with the depending leg 67 of the inverted L-shaped member 64 for engagement therewith.

To lock the slideable outer frame 14 relative to the stationary inner frame 47, the slideable outer frame is moved inwardly toward the stationary inner frame and when the depending leg 67 of the member 64 is adjacent the U-shaped bracket 68, the arm 34 of the outer slideable seat frame 14 is lifted so that the extending leg 67 of the L-shaped member can be inserted into the U-shaped bracket 68, as seen in FIG. 5, and when thus inserted the outer seat section 10 and the inner section 12 are interlocked, and when thus interlocked the outer and inner sections can be moved about the room as an integral unit.

To permit sliding movement of the seat section 10 relative to the stationary inner section 12, such as when converting same into a bed, the arm 34 of the outer section 10 is manually raised thus lifting the entire frame of the outer section and effecting disengagement of the L-shaped member 64 from the U-bracket 68 so that the outer section can then be slid longitudinally outward of the stationary inner section.

The seat section 10 has a removable back pillow generally indicated at 70 which is removable when the seat section is converted to a bed. It will be understood that the frames are suitably upholstered.

What is claimed is:

1. A seating unit convertible to a bed comprising, an outer seating section, with said outer seating section having means at its opposite ends for independently supporting said outer seating section on a floor surface, which outer seating section forms a slideable unit, an independent inner section positioned within the outer seating section and with said inner section having means at its opposite ends for independently supporting said inner section on a floor surface independently of said outer seating section, said inner section being spaced from said outer section when said outer section is positioned over said inner section so that sliding of said outer section longitudinally with respect to said inner section does not affect said stationary inner section, said inner section remaining stationary as said outer section is slid longitudinally of said inner section so that the outer seating section forms a continuation of said stationary inner section to convert said unit to a bed.

2. A seating unit convertible to a bed as set forth in claim 1 in which the inner stationary section has an arm adjacent the outer end thereof.

3. A seating unit convertible to a bed as set forth in claim 1 in which the outer seating section has an arm rest adjacent one of the ends thereof.

4. A seating unit convertible to a bed as set forth in claim 3 in which the inner section has an arm adjacent the outer end thereof so that when the outer seating section is slid inwardly toward said stationary inner section the arm on said stationary section is adjacent the opposite end of the outer seating section.

5. A seating unit convertible to a bed as set forth in claim 1 in which one of said sections has stop means engaging the other section to prevent the separation of one section with respect to the other when said outer seating section is moved laterally outward with respect to said stationary inner section.

6. A seating unit convertible to a bed as set forth in claim 1 in which said sections have locking means for locking same together when said slideable seating section is positioned over said stationary inner section so that both said sections may be moved about as an integral unit.

7. A seating unit convertible to a bed as set forth in claim 1 in which the outer slideable seating section comprises a frame of generally rectangular shape having spaced longitudinal side rails and end rails and forming a pocket for receiving the stationary inner section, and in which the stationary inner section has a frame of generally rectangular shape having longitudinal side members and end members, and in which the longitudinal side members and top of the stationary inner section are spaced from the longitudinal side rails and end rails of the slideable outer seating section.

8. A seating unit convertible to a bed as set forth in claim 7 in which the frame of the seating section has an arm rest frame at the outer end thereof.

9. A seating unit as set forth in claim 7 in which the frame of the outer slideable seating section has legs at its opposite ends for independently supporting said frame and in which the frame of the inner stationary section has legs at its opposite ends for independently supporting said inner stationary frame.

* * * * *